US006758181B2

(12) United States Patent
Iida et al.

(10) Patent No.: US 6,758,181 B2
(45) Date of Patent: Jul. 6, 2004

(54) STARTER

(75) Inventors: Giichi Iida, Tokyo (JP); Junichi Akaike, Tokyo (JP)

(73) Assignee: Kioritz Corporation, Tokyo (JP)

( * ) Notice: Subject to any disclaimer, the term of this patent is extended or adjusted under 35 U.S.C. 154(b) by 262 days.

(21) Appl. No.: 10/047,314

(22) Filed: Jan. 14, 2002

(65) Prior Publication Data

US 2002/0092493 A1 Jul. 18, 2002

(30) Foreign Application Priority Data

Jan. 16, 2001 (JP) ..... 2001/008004
Aug. 24, 2001 (JP) ..... 2001-253966

(51) Int. Cl.[7] ..... F02N 17/00
(52) U.S. Cl. ..... 123/179.24; 123/179.25
(58) Field of Search ..... 123/179.24, 179.25, 123/179.1, 185.14

(56) References Cited

U.S. PATENT DOCUMENTS 3,395,687 A 8/1968 Harkness
4,909,200 A * 3/1990 Sumi ..... 123/179.24
4,930,467 A * 6/1990 Masuda et al. ..... 123/179.24
5,537,966 A 7/1996 Ohnishi
6,230,678 B1 * 5/2001 Gracyalny et al. ..... 123/185.14

FOREIGN PATENT DOCUMENTS

DE 42 15 509 A 1 11/1993

* cited by examiner

*Primary Examiner*—Bibhu Mohanty
(74) *Attorney, Agent, or Firm*—Baker Botts LLP

(57) ABSTRACT

A starter which is capable of smoothly and reliably starting an internal combustion engine even though an electric motor employed is relatively small in size and output, thereby making it possible to minimize power consumption of the electric motor, to miniaturize the capacity of battery, to reduce the total weight of the starter, to enhance the durability of the starter, and to suppress the generation of failure of the starter. This starter comprises a buffering/power-accumulating means disposed midway along a power transmission system between a driving member and a driven member, wherein the buffering/power-accumulating means is enabled, during the driving process, to accumulate the power supplied through the driving process while alleviating any impact to the driven member, the accumulated power being subsequently employed to drive the driven member, and wherein the driving member is an electric motor.

11 Claims, 6 Drawing Sheets

STARTER

BACKGROUND OF THE INVENTION

1. Field of the Invention

The present invention relates to a starter to be employed for the start-up of an internal combustion engine by means of an electric motor, and in particular, to a starter provided with an electric motor which is capable of smoothly and reliably starting the internal combustion engine even though the electric motor employed therein is relatively small in size and output.

2. Description of the Related Art

A D.C. motor type starter which is provided with an electric motor for starting an internal combustion engine such as an small air-cooled two-stroke internal combustion engine which is designed to be mounted on a portable power working machine such as a brush cutter is generally constructed, as described in Japanese Utility Model Publication H6-19828, in such a manner that the driving force of an electric motor is directly transmitted via a speed reduction gear mechanism to the crankshaft of the internal combustion engine.

However, since the conventional D.C. motor type starter is designed such that the driving force of the electric motor is directly transmitted, as it is, to the crankshaft, it is required to employ an electric motor which is capable of obtaining a sufficient torque or revolving speed which is required for the start-up of the engine, i.e. an electric motor which is relatively large in size as well as in output.

This results in an increase in power consumption by the motor, thereby necessitating the employment of a battery of large capacity, and at the same time, results in an increase in impact to the motor as well as to the power-transmission system of the motor at the moment of starting the engine, thereby necessitating the employment of constituent components having a large mechanical strength and an increased stiffness for the starter. As a result, the total weight of the starter would be caused to increase, simultaneously raising various problems such as the deterioration of durability of the starter and the failure of the starter due to kick-back, etc.

BRIEF SUMMARY OF THE INVENTION

The present invention has been made in view of the aforementioned problems, and therefore, it is an object of the present invention to provide a starter which is capable of smoothly and reliably starting an internal combustion engine even though the electric motor employed is relatively small in size and output, thereby making it possible to minimize the power consumption of the electric motor, to miniaturize the capacity of battery, to reduce the total weight of the starter, to enhance the durability of the starter, and to suppress the generation of failure of the starter.

With a view to attaining the aforementioned object, there is provided, in accordance with the present invention, a starter which fundamentally comprises a buffering/power-accumulating means disposed midway along the power transmission system between a driving member and a driven (idler) member, wherein the buffering/power-accumulating means is enabled, during the driving process by the driving member, to accumulate the power supplied through the driving process while alleviating any shock to the driven member, the accumulated power being subsequently employed to drive the driven member, and wherein the driving member is an electric motor acting as a driving source.

In a preferred embodiment of the present invention, the driven member is provided with a centrifugal clutch which is designed to be disengaged by an effect of the centrifugal force to be generated by the rotation of the driven member, and the driven member is interlocked via the centrifugal clutch with the driving member.

Preferably, the buffering/power-accumulating means is constituted by a spiral spring mechanism. It is also preferable that a speed-reduction mechanism is interposed between the buffering/power-accumulating means and the electric motor.

In another preferred embodiment of the present invention, the spiral spring mechanism comprises a spiral spring case which is disposed close to the electric motor, an actuating pulley which is disposed close to the driven member, and a spiral spring which is interposed between the spiral spring case and the actuating pulley, wherein an outer end of said spiral spring and an inner end of said spiral spring are secured to the spiral spring case and to the actuating pulley, respectively.

Preferably, the speed-reduction mechanism is constituted by a worm gear device comprising a worm fixed to an output rotation axis of the electric motor, and a worm wheel provided on an outer circumference of the spiral spring case.

Preferably, the spiral spring of the spiral spring mechanism comprises an outer circumferential wound portion where a predetermined number of turns of the outer circumferentially wound portion of the spiral spring are closely contacted with each other under a freely released condition of the spiral spring, and an inner circumferential wound portion which is constituted by at least one turn of the inner circumferentially wound portion of the spiral spring, wherein a clearance is provided between the outer circumferential wound portion and the inner circumferential wound portion. More preferably, the outer circumferential wound portion is constituted by a third turn and the following turns successive to the third turn, and the inner circumferential wound portion is constituted by a first turn and at least a portion of the second turn which is closely contacted with the first turn.

In another preferred embodiment of the present invention, a recoil type driving member is additionally provided close to the driving member in separate from the electric motor, wherein the recoil type driving member comprises a rope reel having a recoil rope wound around the rope reel which is designed to be revolved by pulling the recoil rope, recoil-urging means for urging the rope reel to reversibly revolve to thereby wind up the recoil rope, and a recoil ratchet mechanism for transmitting the rotation of the rope reel to the buffering/power-accumulating means.

In another preferred embodiment of the present invention, the spiral spring mechanism is provided with a one-way clutch which enables the spiral spring case to revolve only unidirectionally.

According to a preferable embodiment of the starter of the present invention having the aforementioned structure, when the internal combustion engine is desired to be started, a starting switch which is separately mounted for the starter should be pushed. As a result, electric current is transmitted for a predetermined period of time (for example, 2 to 3 seconds) from a battery mounted on the engine to the electric motor, thereby enabling the electric motor (the output rotation axis thereof) to rotate for aforementioned predetermined period of time, thus producing a rotational driving force, which is then transmitted, via the spiral spring mechanism constituting the buffering/power-accumulating means and the driven member, to the crankshaft of the internal combustion engine.

In this case, during the first-half driving process by means of the electric motor (until the piston of the internal combustion engine reaches the top dead center of the internal combustion engine), it is possible to derive a buffering effect from the spiral spring mechanism, and at the same time, to accumulate the driving force of the electric motor in a spiral spring mechanism, and during the latter-half driving process, the driving force thus accumulated in the spiral spring mechanism during the first-half driving process is permitted to be combined with the driving force to be actually effected by the electric motor in the latter-half driving process to thereby generate a resultant force, the energy of which being sufficiently large enough to overcome the load of the compression of the engine, thus providing a sufficient energy for starting the internal combustion engine.

Therefore, the internal combustion engine can be smoothly and reliably started an even though the electric motor employed therein is relatively small in size and output, thereby making it possible to minimize the power consumption of the electric motor, to miniaturize the capacity of the battery, to reduce the total weight of the starter, to enhance the durability of the starter, and to suppress the generation of failure of the starter, thus resulting in the improvement of reliability of the starter.

DETAILED DESCRIPTION OF THE INVENTION

Next, one embodiment of the starter according to the present invention will be explained with reference to the drawings.

Figure 1:
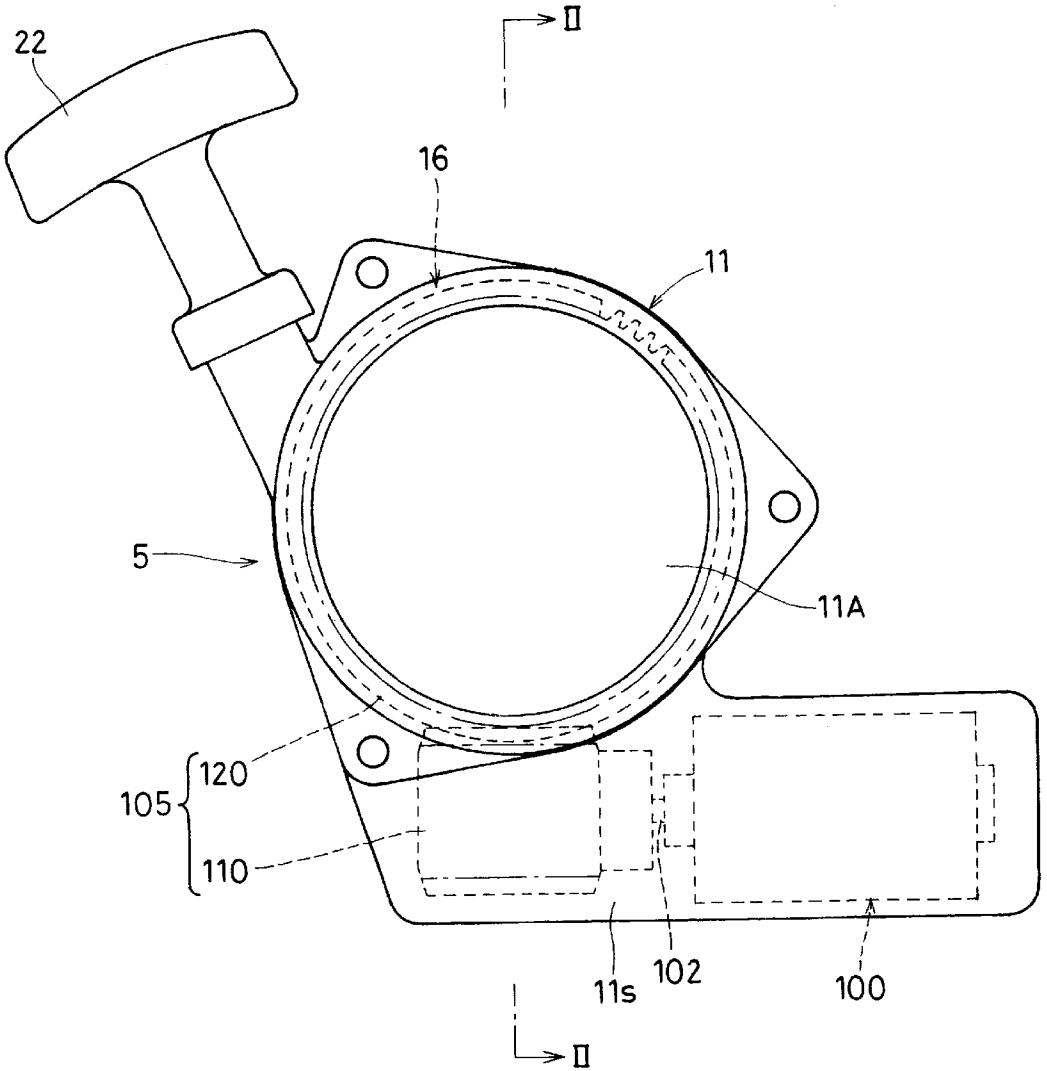
FIG. 1 is a front side view of a starter representing one embodiment of the present invention.
Figure 2:
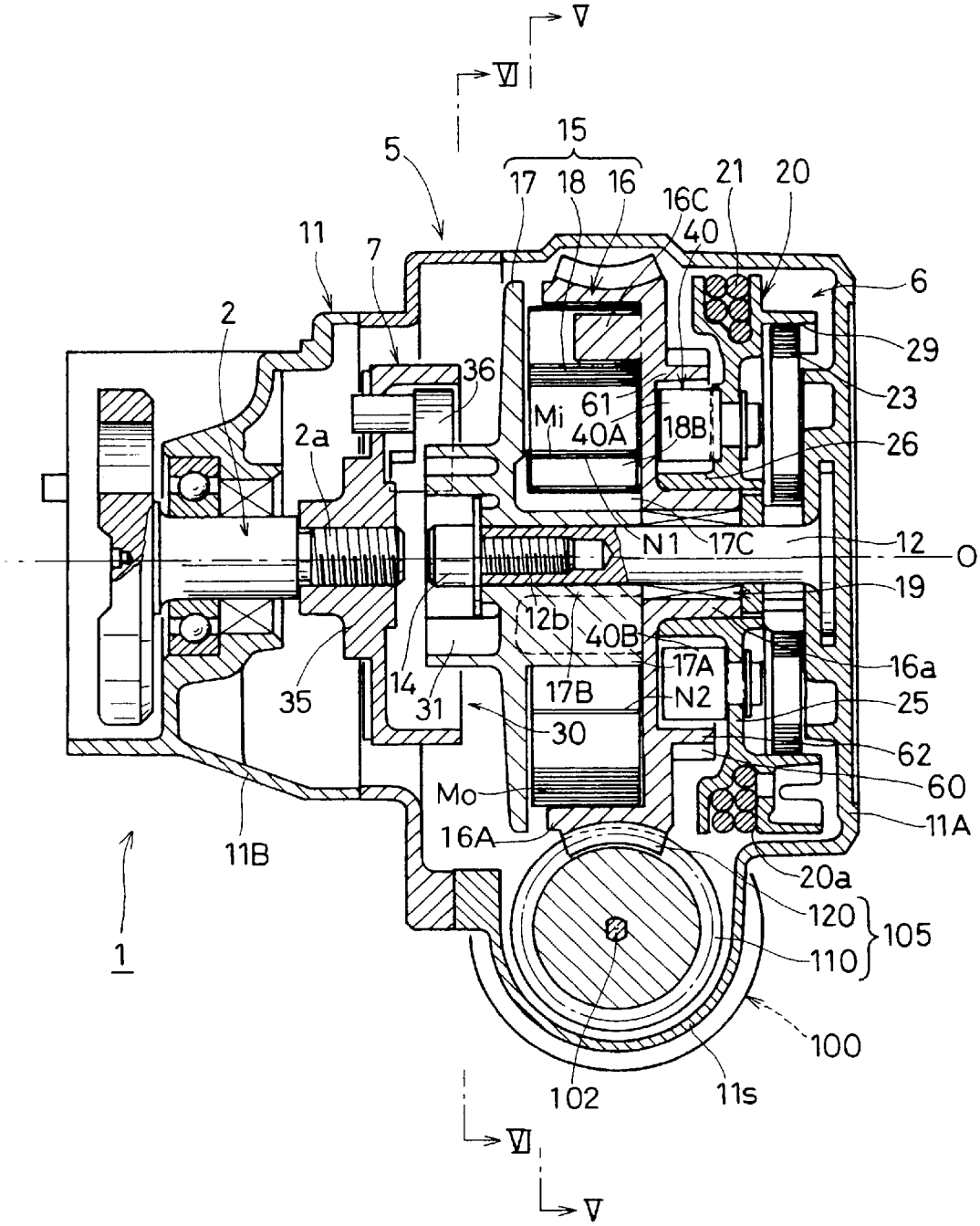
FIG. 2 is an enlarged sectional view taken along the line II—II of FIG. 1.

FIG. 1 is a front side view of a starter representing one embodiment of the present invention, and FIG. 2 is an enlarged sectional view taken along the line II—II of FIG. 1. Referring to these FIGS. 1 and 2, the starter 5 shown therein is disposed close to one end 2*a* of a crankshaft 2 of an internal combustion engine 1 such as a small air-cooled internal combustion engine of 23 to 50 mL in displacement. Although the primary starting system of the engine 1 is constituted by a D.C. motor system, the engine 1 is also enabled to start by a recoil system (manual starting system) in order to cope with the situations where the engine cannot be started by way of the D.C. motor system due to insufficient charging of the battery, or where the D.C. motor is gone out of order.

The starter 5 comprises a case 11 which is adapted to be mounted on one sidewall of the internal combustion engine 1. This case 11 is composed of a two-piece structure forming a cylindrical structure. A motor case 11*s* having a semi-cylindrical proximal end portion and a cylindrical distal end portion is attached to the underside of an outer case member 11A of the case 11, which is disposed remote from the internal combustion engine 1 and extended rightward in FIG. 1. Inside this motor case 11*s* is horizontally disposed an electric motor 100 acting as a driving member for starting the internal combustion engine 1, the electric power for this electric motor 100 being supplied from a battery (not shown) or a D.C. power source employed as a driving source.

Further, inside the outer case member 11A is disposed a recoil type driving member 6 which is designed to be rotated by pulling manipulation of a recoil rope 21 (a recoil handle 22). Additionally, inside an inner case member 11B of the case 11, which is disposed close to the engine 1, there is disposed a driven member 7 which can be rotated independent from the recoil type driving member 6 and to which a driving power to be provided by the electric motor 100 and the recoil type driving member 6 is transmitted.

An anchoring shaft 12 is disposed extending along the axial center of the outer case member 11A. A rope reel 20 having the recoil rope 21 wound therearound is rotatably fitted on the proximal end portion of the anchoring shaft 12, and a buffering/power-accumulating means 15 comprising a spiral spring case 16 acting as an interlocking rotational body, an actuating pulley 17 and a buffering/power-accumulating spiral spring 18 is rotatably fitted on the protruded end portion of the anchoring shaft 12, i.e. midway between the rope pulley 20 and an interlocking pulley 35 constituting a driven member 7 so as to permit the buffering/power-accumulating means 15 to be rotated independent from the rope pulley 20. At the same time, a stopper screw 14 is screw-engaged with the protruded end portion of the anchoring shaft 12.

In this case, the central axial line of the anchoring shaft 12, the rotational axial line of the rope pulley 20, the rotational axial line of the buffering/power-accumulating means 15, and the rotational axial line of the interlocking pulley 35 constituting the driven member 7 are all disposed so as to lie on a rotational axial line 0 of the crankshaft 2, while the output rotational axis 102 of the electric motor 100 is positioned so as to orthogonally intersect with the rotational axial line 0 of the crankshaft 2.

The driving force of the electric motor 100 is designed to be transmitted to the buffering/power-accumulating means 15 through a worm gear device 105 functioning as a speed reduction mechanism and comprising a worm 110 which is coupled to the output rotational axis 102, and a worm wheel 120 attached to the outer circumference of the spiral spring case 16. The driving force thus transmitted to the buffering/power-accumulating means 15 is then transmitted therefrom to the crankshaft 2 of the internal combustion engine 1 through the interlocking pulley 35. As a separate system which is independent from the aforementioned driving force-transmitting system, the rotation of the rope pulley 20 is also designed to be transmitted to the crankshaft 2 of the internal combustion engine 1 through the buffering/power-accumulating means 15 and through the interlocking pulley 35.

By the way, it is also preferable that the worm wheel device 105 is provided with a reversible worm or a suitable clutch means (both not specifically shown) so as to enable the spiral spring case 16 to be rotated by way of the rope pulley 20 without being subjected to the braking action by the worm 110.

Figure 3:
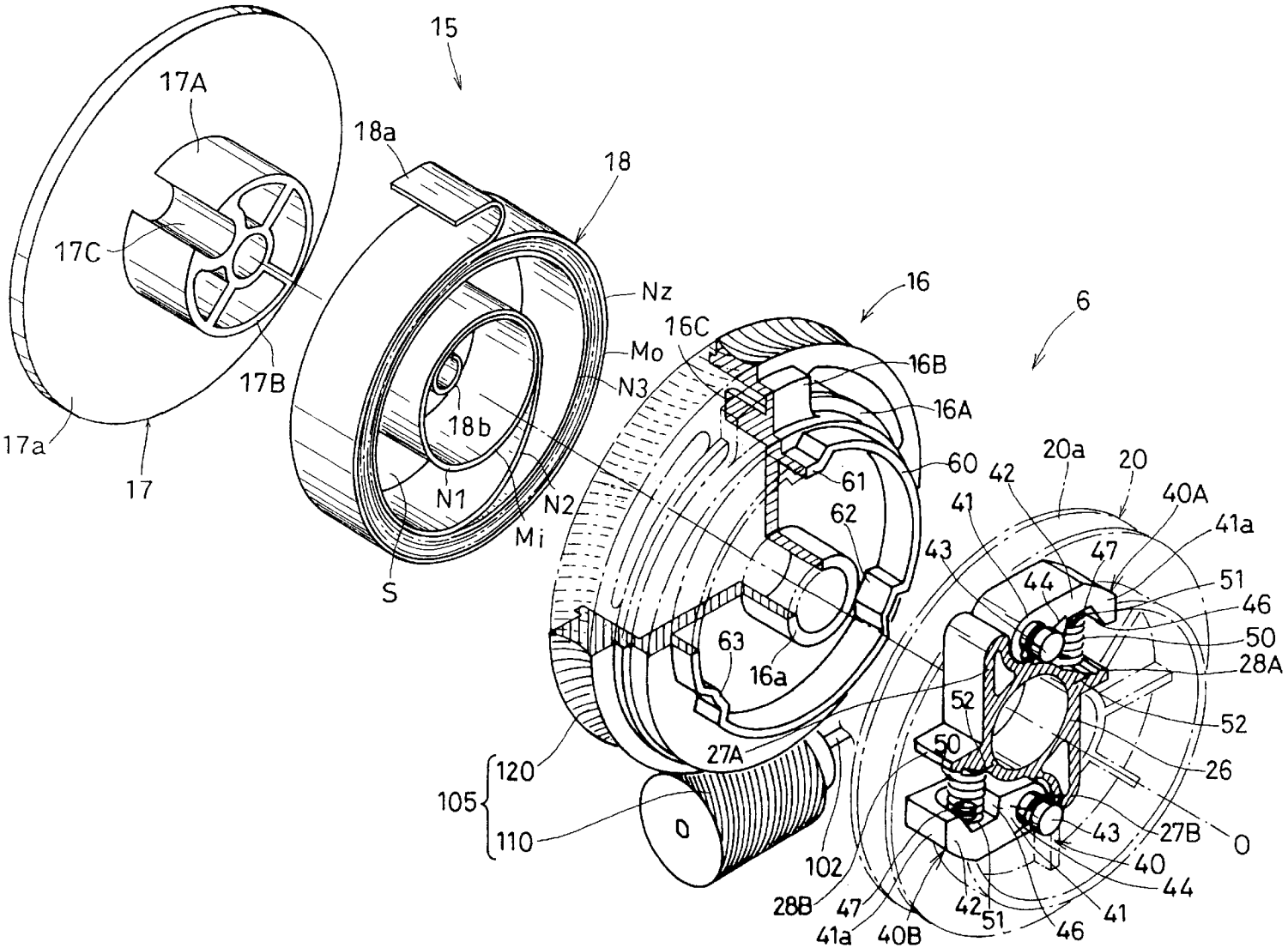
FIG. 3 is a partially cut out exploded perspective view showing a recoil ratchet mechanism, a spiral spring and a worm wheel device, all designed to be installed in the recoil starter shown in FIG. 2.
Figure 4:
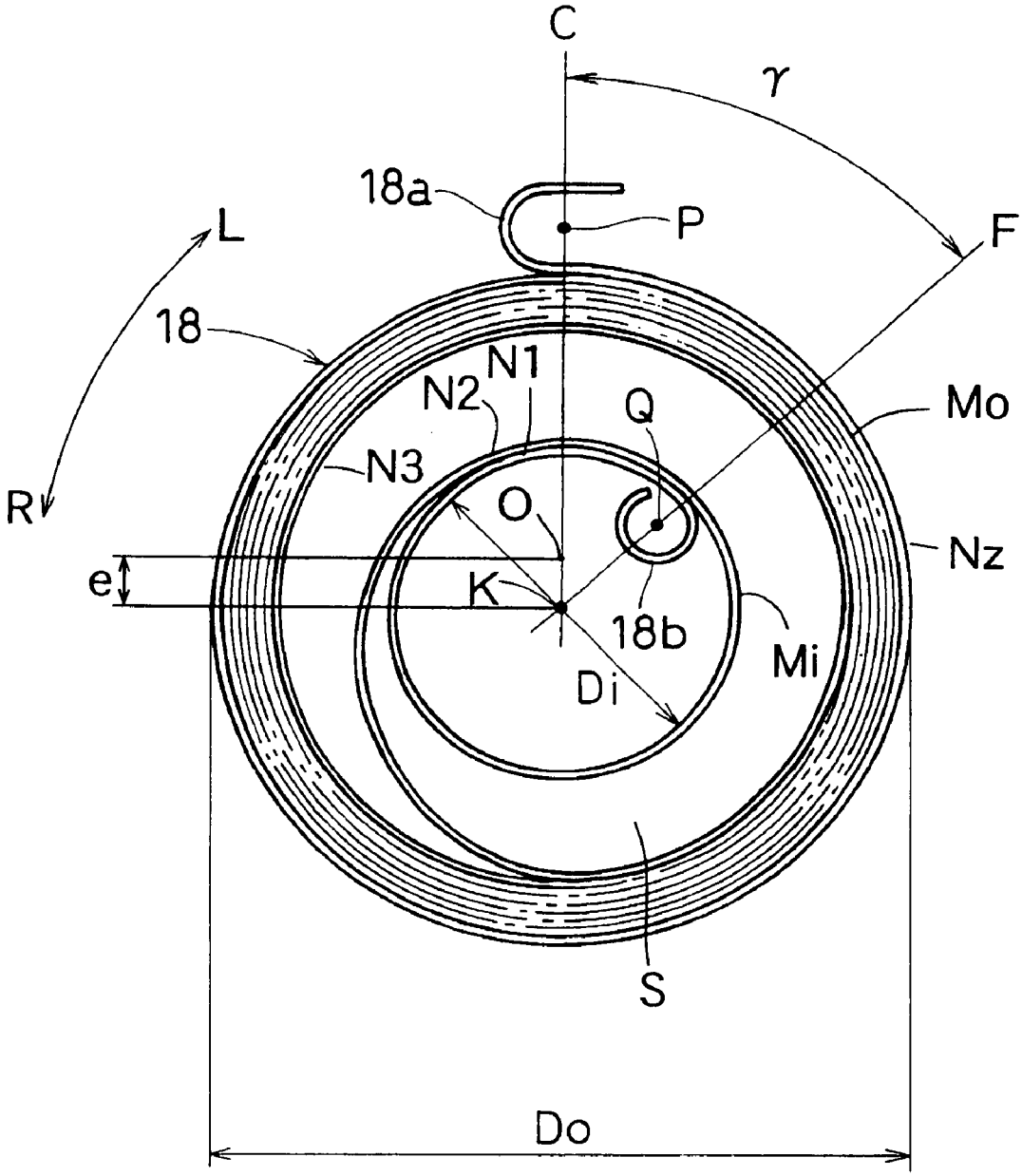
FIG. 4 is a view showing a freely released state of the spiral spring before the spiral spring is installed in the recoil starter shown in FIG. 2.
Figure 5:
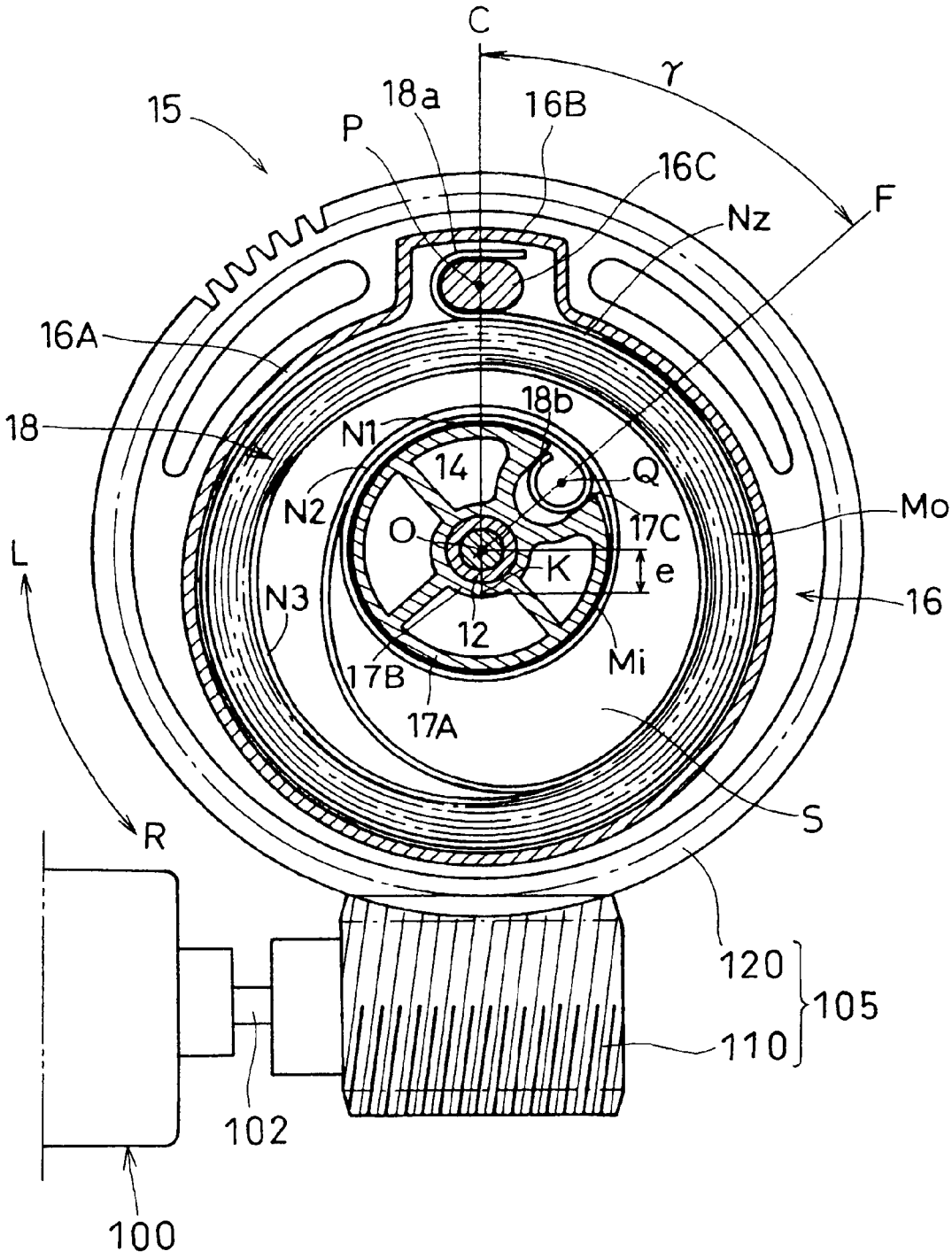
FIG. 5 is a cross-sectional view taken along the line V—V of FIG. 2.

As clearly seen from FIGS. 3 to 5 in addition to FIG. 2, the buffering/power-accumulating means 15 comprises the spiral spring case 16 which is disposed close to the recoil type driving member 6, the actuating pulley 17 which is disposed close to the driven member 7, and the spiral spring 18 which is interposed between the spiral spring case 16 and the actuating pulley 17, wherein the buffering/power-accumulating spiral spring 18 is interposed between the spiral spring case 16 disposed on the input side and the actuating pulley 17 on the output side. Further, the spiral spring case 16 and the actuating pulley 17 are coaxially arranged so as to lie on the same axis 0, thereby enabling them to be rotated relative to each other. As described hereinafter, the outer end portion 18*a* of the spiral spring 18 is secured to the spiral spring case 16, while the inner end portion 18*b* thereof is secured to the actuating pulley 17, so that when either one of the spiral spring case 16 and the actuating pulley 17 is rotated relative to the other, the torque thereof is permitted to be given to the other.

More specifically, as clearly shown in FIG. 4 where the spiral spring 18 is shown as it is taken out of the spiral spring mechanism 15 (a freely released state thereof before being assembled), the spiral spring 18 is provided with a U-shaped external hook end 18*a* constituting the outer end portion thereof, and with an annular internal hook end 18*b* constituting the inner end portion thereof. In a freely released state of the spiral spring 18, an outer circumferential wound portion Mo where a predetermined number of turns of the spiral spring 18 are closely contacted is formed, and an inner circumferential wound portion Mi which is constituted by at least one turn is formed, wherein a clearance S is provided between the outer circumferential wound portion Mo and the inner circumferential wound portion Mi.

More specifically, the outer circumferential wound portion Mo is constituted by a third turn N3 and the following turns (including the outermost turn Nz) successive to the third turn N3, while the inner circumferential wound portion Mi is constituted by a first turn N1 and at least a portion of the second turn N2 which is closely contacted with the first turn N1. Further, the annular internal hook end 18*b* is positioned so as to be displaced from the location of the external hook end 18*a* by a predetermined angle $\gamma$ (40 to 50 degrees in this embodiment) toward the direction L which is opposite to the driving direction R to be explained hereinafter. By the way, this angle $\gamma$ is an angle formed between a straight line C passing through the center K of the spiral spring 18 and through the center P of the external hook end 18*a* (or of an external end-fastening stub 16C which is formed in the spiral spring case 16 as explained hereinafter), and a straight line F passing through the center K of the spiral spring 18 and through the center Q of the internal hook end 18*b* (or of an internal end-fastening portion 17C which is formed in the actuating pulley 17 as explained hereinafter).

The spiral spring 18 is formed of a stainless steel sheet having a thickness of 0.5 to 0.7 mm, and the effective inner diameter Di of the first turn N1 is set to about 30 mm. An annealing treatment is performed on the inner circumferential wound portion Mi of the spiral spring 18 (at least the first turn N1 and the second turn N2 thereof).

The spiral spring case 16 is provided with a cylindrical boss portion 16*a* at the center of a sidewall thereof facing the recoil type driving member 6. A one-way clutch 19 is interposed between the inner peripheral wall of the cylindrical boss portion 16*a* and the anchoring shaft 12, so that the spiral spring case 16 is rotatably supported by the anchoring shaft 12 in such a manner that it can be rotated unidirectionally (in the rewinding direction R of the spiral spring 18) about the anchoring shaft 12. The spiral spring case 16 is further provided, on one of the sidewalls thereof facing the driven member 7, with a projected short cylindrical portion 16A for housing the spiral spring 18. This spiral spring-housing cylindrical portion 16A is provided with a disengagement-preventing protruded portion 16B which is outwardly projected in the radial direction for housing therein the external hook end 18*a* of the spiral spring 18. Inside this protruded portion 16B, there is disposed the external end-fastening stub 16C having an oval cross-section, which is protruded toward the driven member 7 so as to be fixedly fitted with the external hook end 18*a*.

On the outer circumferential wall of the spiral spring-housing cylindrical portion 16A of the spiral spring case 16, there is mounted the worm wheel 120 of the worm gear device 105, the rotational axis of which is made coaxial with the rotational axial line 0 of the crankshaft 2.

The actuating pulley 17 is provided, at the center of the sidewall thereof facing the recoil type driving member 6, with a projected cylindrical boss portion 17B which is rotatably fitted idle on the anchoring shaft 12. This cylindrical boss portion 17B is provided on the outer circumferential wall thereof with a core portion 17A around which the spiral spring 18 is designed to be wound. This core portion 17A is provided with the internal end-fastening portion 17C forming a longitudinal groove having a U-shaped cross-section so as to enable the ring-like internal hook end 18*b* of the spiral spring 18 to be fitted and engaged therewith.

The outer diameter of the core portion 17A is made almost identical with the effective inner diameter Di of the first turn N1 of the spiral spring 18. The effective outer diameter Do of the spiral spring 18 under the freely released condition thereof is made almost identical with the effective inner diameter of the spiral spring-housing cylindrical portion 16A of spiral spring case 16.

Additionally, according to this embodiment, the rotational axial line 0 of the spiral spring mechanism 15 is displaced from the proper center K of the spiral spring 18 by a predetermined distance "e" toward the external hook end 18*a* as shown in FIG. 4. In other words, under the assembled condition of the spiral spring mechanism 15, where the spiral spring 18 is housed inside the spiral spring-housing cylindrical portion 16A of the spiral spring case 16, where the core portion 17A of the actuating pulley 17 is fitted in the inner circumferential wound portion Mi of the spiral spring 18, and where the external hook end 18*a* and internal hook end 18*b* of the spiral spring 18 are anchored to the external end-fastening stub 16C and the internal end-fastening portion 17C, respectively, the center of the inner circumferential wound portion Mi of the spiral spring 18 is decentered from the proper center K of the spiral spring 18 by the predetermined distance "e" toward the external hook end 18*a*. As a result, the range of contact between the first turn N1 and the second turn N2 of the spiral spring 18 is increased, thereby improving the retention force of the spiral spring 18 to wind around the core portion 17A of the actuating pulley 17.

On the other hand, between the outer case member 11A and the spiral spring case 16, there is disposed a rope pulley 20 having a stepped disc-like configuration. This rope pulley 20 is provided on the outer peripheral wall thereof with annular groove 20*a* so as to enable the recoil rope 21 to be wound around it. This rope pulley 20 is further provided at the center of inner peripheral side thereof with a cylindrical boss 26 which is designed to be rotatably fitted on the cylindrical boss portion 16*a* of the spiral spring case 16. This cylindrical boss 26 is provided with a pair of claw-retaining portions 27A and 27B to be engaged with a recoil ratchet mechanism 40, and a pair of spring retaining portions 28A and 28B each corresponding to the claw-retaining portions 27A and 27B, respectively. These spring retaining portions 28A and 28B as well as claw-retaining portions 27A and 27B are respectively spaced apart from each other by an angle of 180 degrees and radially extended outward, thereby forming a cross-shaped or ⊠-shaped configuration constituted by a total of these four portions.

Figure 6:
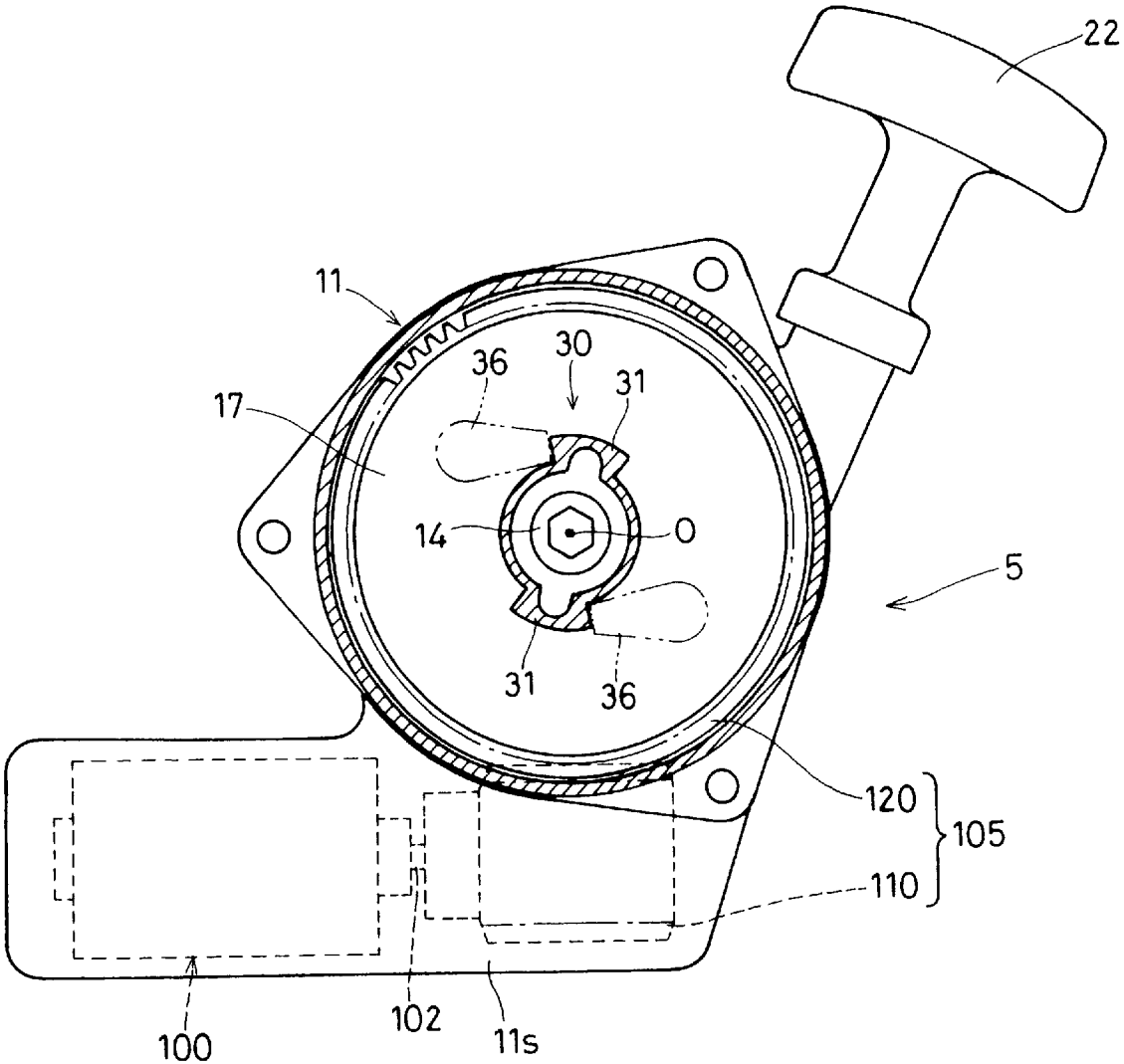
FIG. 6 is a sectional view taken along the line VI—VI of FIG. 2.

In the same manner as in the case of the conventional recoil type starter, although details are not shown in the drawings, one end of the rope 21 is fastened to a bottom portion of the groove 20*a*, while the other end of the rope 21 which is extended out of the outer case member 11A is fastened to the recoil handle 22 (see FIGS. 1 and 6).

Further, between the rope reel 20 and the outer case member 11A, there is interposed a recoil spiral spring 23, the outer end of which being fastened to the rope reel 20, and the inner end of which being fastened to a central portion of the outer case member 11A. The rope reel 20 is designed to be rotated by pulling the rope 21, and then allowed to return to the original portion on account of the restoring force accumulated in the recoil spiral spring 23, thereby enabling the rope 21 to be automatically wound up.

The recoil ratchet mechanism 40 is interposed between the rope reel 20 and the spiral spring case 16.

As clearly seen from FIGS. 2 and 3, the recoil ratchet mechanism 40 comprises, on one of the sidewalls of the rope pulley 20 facing the spiral spring case 16, a couple of ratchet claws 40A and 40B which are spaced apart from each other by an angle of 180 degrees and enabled respectively to swing, a couple of compressing coil springs 50 functioning respectively as an urging member for urging the couple of ratchet claws 40A and 40B to outwardly turn in the radial direction, and a short cylindrical claw-receiving portion 60 which is projected from one of the sidewalls of the spiral spring case 16 facing the rope pulley 20. The claw-receiving portion 60 is provided with three trapezoidal engaging portions 61, 62 and 63 which are spaced apart from each other by an angle of a (an angle of 120 degrees in this embodiment) and are depressed inwardly.

The ratchet claws 40A and 40B are respectively constituted by a proximal end portion 41 having a semi-cylindrical surface and provided with an oscillating axis 43 which is rotatably fitted in the vicinity of each of a couple of claw-retaining portions 27A and 27B formed on the plate portion 25 of the rope pulley 20, and by an arm portion 42 extended from the proximal end 41 and having an inwardly bent distal end 41*a*. By the way, the semi-cylindrical surface of the proximal end portion 41 is designed to be slidably contacted with the claw-retaining portion 27A or 27B.

Between the arm portions 42 and a pair of the spring retaining portions 28A and 28B of the cylindrical boss portion 26 of the rope pulley 20, there are interposed a pair of the compressing coil springs 50 each functioning as an urging member for always urging the ratchet claws 40A and 40B so as to outwardly turn in the radial direction, thereby enabling the bent distal end portion 41*a* to be pressed against the claw-receiving portion 60 of the spiral spring case 16, whereby the bent distal end portions 41*a* are permitted to be engaged, in a proper posture, with the engaging portions 61, 62 and 63.

In this case, one end portion 51 of each of the compressing coil springs 50 is inserted into a disengagement-preventing recessed portion 46 which is provided at the distal end of the arm portion 42 of each of the ratchet claws 40A and 40B, and at the same time, the one end portion 51 of each of the compressing coil springs 50 is externally fitted over a disengagement-preventing protruded portion 47 which is projected inside the recessed portion 46. On the other hand, the other end portion 52 of each of the compressing coil springs 50 is bent in the form of hook so as to be introduced into and engaged with a hanging hole formed in the rope reel 20.

The driven member 7 is constituted by the interlocking pulley 35, and a centrifugal clutch type ratchet mechanism 30. As clearly seen from the FIG. 6, the centrifugal clutch type ratchet mechanism 30 comprises a pair of power-transmitting engaging protrusions 31 which are projected from one of the sidewalls of the actuating pulley 17 facing the engine 1, and the interlocking pulley 35 which is anchored to the one end 2*a* of the crankshaft 2. A couple of starting claws 36 for instance are swingably supported by the interlocking pulley 35. These starting claws 36 are generally urged to turn inward (toward the rotational axial line 0) by means of biased spring (not shown), thereby enabling these starting claws 36 to be engaged with the power-transmitting engaging protrusions 31. However, when the internal combustion engine 1 is started, these starting claws 36 are caused to outwardly turn radially due to the centrifugal force generated by the rotation of the interlocking pulley 35 that has been driven by the crankshaft 2. In this case, when the rotational speed of the crankshaft 2 exceeds over a predetermined value, the aforementioned engagement is enabled to be automatically disengaged.

In the case of the starter 5 according to this embodiment which is constructed as explained above, when the internal combustion engine 1 is desired to be started, a starting switch which is separately mounted for the starter 5 is pushed. As a result, electric current is transmitted for a predetermined period of time (for example, 2 to 3 seconds) from the battery mounted on the internal combustion engine 1 to the electric motor 100, thereby enabling the output rotation axis 102 of the electric motor 100 to rotate for aforementioned predetermined period of time, thus producing a rotational driving force by the electric motor 100, which is then transmitted, via the worm gear device 105 functioning as a speed reduction mechanism, to the buffering/power-accumulating spiral spring mechanism 15. The driving force thus transmitted to this spiral spring mechanism 15 is then further transmitted therefrom, via the driven member 7, to the crankshaft 2 of the internal combustion engine 1.

In this case, during the first-half driving process by means of the electric motor 100 (until the piston of the internal combustion engine 1 reaches the top dead center), it is possible to derive a buffering effect from the spiral spring mechanism 15, and at the same time, to accumulate the driving force of the electric motor 100 in a spiral spring mechanism 15, and during the latter-half process, the driving force thus accumulated in the spiral spring mechanism during the first-half process is permitted to be combined with the driving force to be actually effected by the electric motor 100 in the latter-half process to thereby generate a resultant force, the energy of which being sufficiently large enough to overcome the load of the compression of the internal combustion engine 1, thus providing a sufficient energy of force for starting the internal combustion engine 1.

Therefore, the internal combustion engine 1 can be smoothly and reliably started an even though the electric motor 100 employed therein is relatively small in size and output, thereby making it possible to minimize the power consumption of the electric motor, to miniaturize the capacity of battery, to reduce the total weight of the starter, to enhance the durability of the starter, and to suppress the generation of failure of the starter, thus resulting in the improvement of reliability of the starter.

In the case of the starter 5 according to this embodiment, since it is constructed such that part of the second turn N2 is closely contacted with the first turn N1 at the inner circumferentially wound portion Mi of the spiral spring 18, that the internal hook end 18*b* is displaced as mentioned above, and that the specifications of the spiral spring 18 and the spiral spring mechanism 15 are designed as explained above, the interlocking between the spiral spring mechanism 15 and the engine 1 can be disengaged from each other after the start-up of the internal combustion engine 1 due to the free releasing effects to be obtained from the centrifugal clutch type ratchet mechanism 30 mounted on the driven member 7, thereby rendering the spiral spring mechanism 15 to be brought into a free state. In this case, even if the spiral spring 18 is kicked back in the unwinding direction (releasing direction) thereof due to the inertia on this occasion after the complete rewinding of the spiral spring 18, this kick-back stress to be repeated by the effects of rewinding-releasing on this occasion can be received by the entire body of the inner circumferentially wound portion Mi, thereby making it possible to suppress the generation of a concentration of the stress in the vicinity of the internal hook end 18*b* of the spiral spring 18.

As a result, the generation of settling or breakage of the spiral spring 18 can be prohibited, thereby making it possible to improve the durability of the spiral spring 18, and at the same time, the internal hook end 18*b* of the spiral spring 18 can be prevented from being easily disengaged from the core portion 17C provided at the actuating pulley 17 of the spiral spring mechanism 15, thereby further improving the reliability of the starter.

On the other hand, when it is impossible, in the starter 5 according to this embodiment, to start the internal combustion engine 1 by way of D.C. motor (due to the run-out of the battery, or due to the failure of the electric motor 100), the internal combustion engine 1 can be started by making use of the recoil type driving member 6.

Namely, when the recoil rope 21 (or the recoil handle 22) is manually pulled so as to rotate the rope pulley 20 in the driving direction (in the direction of R in FIG. 5). As a result, a couple of the ratchet claws 40A and 40B (which are spaced apart from each other by an angle of 180 degrees) are enabled to rotate integral with the rope pulley 20. When this couple of ratchet claws 40A and 40B are rotated, one of the ratchet claws, e.g. the ratchet claw 40A is permitted to contact with one of three engaging portions 61, 62 and 63 that have been provided in the spiral spring case 16, e.g. the engaging portion 61, thereby enabling the rotation of the rope pulley 20 to be transmitted to the spiral spring case 16.

When the operation of pulling the rope 21 is performed in this manner, the rotation of the recoil type driving member 6 can be transmitted, via the spiral spring mechanism 15 and the interlocking pulley 35, to the crankshaft 2 of the internal combustion engine 1.

As in the case of starting the engine by way of the aforementioned D.C. motor, during the first-half driving process (until the piston of the internal combustion engine 1 reaches the top dead center) in the operation of pulling the recoil rope 21 (recoiling operation), it is possible to derive a buffering effect from the spiral spring mechanism 15, and at the same time, to accumulate the drawing force of the recoiling rope 21 in the spiral spring mechanism 15, and during the latter-half process, the driving force thus accumulated in the spiral spring mechanism 15 during the first-half process is permitted to be combined with the pulling force to be actually effected by the recoiling rope 21 in the latter-half process to thereby generate a resultant force, the energy of which being sufficiently large enough to overcome the load of the compression of engine 1, thus providing a sufficient energy of force for starting the internal combustion engine 1.

As a result, it is possible to minimize a fluctuation in pulling force of rope so as to make smooth the rope-pulling operation, thus enabling even a person having a weak physical strength to easily start the engine (for more details, see Japanese Patent Application No. H11-238642).

While in the foregoing a couple of embodiments of the present invention have been explained, it will be understood that the construction of the device can be varied without departing from the spirit and scope of the invention.

As clearly seen from the above explanation, since a buffering/power-accumulating means such as a spiral spring mechanism is interposed midway along the power transmission system between an electric motor and a driven (idler) member in the starter of the present invention, it is now possible to smoothly and reliably start an internal combustion engine even with an electric motor which is relatively small in size and output, thereby making it possible to minimize the power consumption of electric motor, to miniaturize the capacity of battery, to reduce the total weight of the starter, to enhance the durability of the starter, and to suppress the generation of failure of starter.

What is claimed is:

1. A starter comprising a buffering/power-accumulating means which is disposed midway along a power transmission system between a driving member and a driven member, wherein:

said buffering/power-accumulating means is enabled, during the driving process by said driving member, to accumulate the power supplied through the driving process while alleviating any shock to said driven member, the accumulated power being subsequently employed to drive said driven member;

said driving member is an electric motor acting as a driving power source;

said driven member is provided with a centrifugal clutch which is designed to be disengaged by an effect of centrifugal force to be generated by the rotation of said driven member, and said driven member is interlocked via said centrifugal clutch with said driving member;

said buffering/power-accumulating means is constituted by a spiral spring mechanism;

a speed-reduction mechanism is interposed between said buffering/power-accumulating means and said electric motor;

said spiral spring mechanism comprises a spiral spring case which is disposed close to said electric motor, an actuating pulley which is disposed close to said driven member, and a spiral spring which is interposed between said spiral spring case and said actuating pulley, an outer end of said spiral spring and an inner end of said spiral spring being secured to said spiral spring case and to said actuating pulley, respectively; and said speed-reduction mechanism is constituted by a worm gear device comprising a worm fixed to an output rotation axis of said electric motor, and a worm wheel provided on an outer circumference of said spiral spring case.

2. The starter according to claim 1, wherein said spiral spring comprises an outer circumferential wound portion where a predetermined number of turns of said outer circumferentially wound portion of said spiral spring are closely contacted with each other under a freely released condition of said spiral spring, and an inner circumferential wound portion which is constituted by at least one turn of said inner circumferentially wound portion of said spiral spring, wherein a clearance is provided between said outer circumferential wound portion and said inner circumferential wound portion.

3. The starter according to claim 2, wherein said outer circumferential wound portion is constituted by a third turn and the following turns successive to the third turn, and said inner circumferential wound portion is constituted by a first turn and at least a portion of second turn which is closely contacted with said first turn.

4. The starter according to claim 3, wherein a recoil type driving member is additionally provided close to said driving member in separate from said electric motor, wherein said recoil type driving member comprises a rope reel having a recoil rope wound around said rope reel which is designed to be revolved by pulling said recoil rope, recoil-urging means for urging said rope reel to reversibly revolve to thereby wind up said recoil rope, and a recoil ratchet mechanism for transmitting the rotation of said rope reel to said buffering/power-accumulating means.

5. The starter according to claim 4, wherein said spiral spring mechanism is provided with a one-way clutch which enables said spiral spring case to revolve only unidirectionally.

6. The starter according to claim 1, wherein said spiral spring comprises an outer circumferential wound portion which is constituted by a third turn and the following turns successive to the third turn, and an inner circumferential wound portion which is constituted by a first turn and at least a portion of second turn which is closely contacted with said first turn.

7. The starter according to 6, wherein a recoil type driving member is additionally provided close to said driving member in separate from said electric motor, wherein said recoil type driving member comprises a rope reel having a recoil rope wound around said rope reel which is designed to be revolved by pulling said recoil rope, recoil-urging means for urging said rope reel to reversibly revolve to thereby wind up said recoil rope, and a recoil ratchet mechanism for transmitting the rotation of said rope reel to said buffering/power-accumulating means.

8. The starter according to claim 7, wherein said spiral spring mechanism is provided with a one-way clutch which enables said spiral spring case to revolve only unidirectionally.

9. The starter according to claim 1, wherein a recoil type driving member is additionally provided close to said driving member in separate from said electric motor, wherein said recoil type driving member comprises a rope reel having a recoil rope wound around said rope reel which is designed to be revolved by pulling said recoil rope, recoil-urging means for urging said rope reel to reversibly revolve to thereby wind up said recoil rope, and a recoil ratchet mechanism for transmitting the rotation of said rope reel to said buffering/power-accumulating means.

10. The starter according to claim 9, wherein said spiral spring mechanism is provided with a one-way clutch which enables said spiral spring case to revolve only unidirectionally.

11. The starter according to claim 1, wherein said spiral spring mechanism is provided with a one-way clutch which enables said spiral spring case to revolve only unidirectionally.

* * * * *